US005178478A

United States Patent [19]

Ryder

[11] Patent Number: 5,178,478

[45] Date of Patent: Jan. 12, 1993

[54] COMBINED LIPSTICK HOLDER AND LIP BRUSH CASE WITH MIRROR AND CLIP

[76] Inventor: Antonia Ryder, 29 Knoll View, Ossining, N.Y. 10562

[21] Appl. No.: 710,291

[22] Filed: Jun. 4, 1991

[51] Int. Cl.[5] ..... B43K 29/00; A45D 42/02

[52] U.S. Cl. ..... 401/195; 401/52; 401/131; 132/315; 132/316; 132/318

[58] Field of Search ..... 132/315, 316, 317, 318, 132/314; 401/52, 131, 195

[56] References Cited

U.S. PATENT DOCUMENTS

| | | | |
|---|---|---|---|
| 1,626,311 | 4/1927 | Tipton | 132/315 |
| 2,452,131 | 10/1948 | Kruck | 132/318 X |
| 2,522,403 | 9/1950 | Ross | 132/318 X |
| 2,552,714 | 5/1951 | Gardiner | 132/318 X |
| 2,619,096 | 11/1952 | Kuhnl | 132/315 |

FOREIGN PATENT DOCUMENTS

| | | | |
|---|---|---|---|
| 909983 | 5/1946 | France | 132/314 |
| 1252717 | 12/1960 | France | 132/315 |
| 8603659 | 7/1986 | World Int. Prop. O. | 132/316 |

*Primary Examiner*—Danton D. DeMille
*Attorney, Agent, or Firm*—Steven H. Bazerman

[57] ABSTRACT

A case is disclosed for holding a lipstick in a conventional lipstick holder in combination with a lip brush, a clip for holding the top of a conventional lipstick and a mirror. The case consists of a hollow cylinder in which the lip brush is held in place by frictional engagement and a platform attached to the bottom of said cylinder having a circular portion in which a conventional lipstick holder can rest. Means for holding the conventional lipstick holder in position and a rotatable cap pivotally mounted on the top of said case to allow access to the lipstick holder during the application of lipstick. The mirror is mounted on the body of the case.

7 Claims, 2 Drawing Sheets

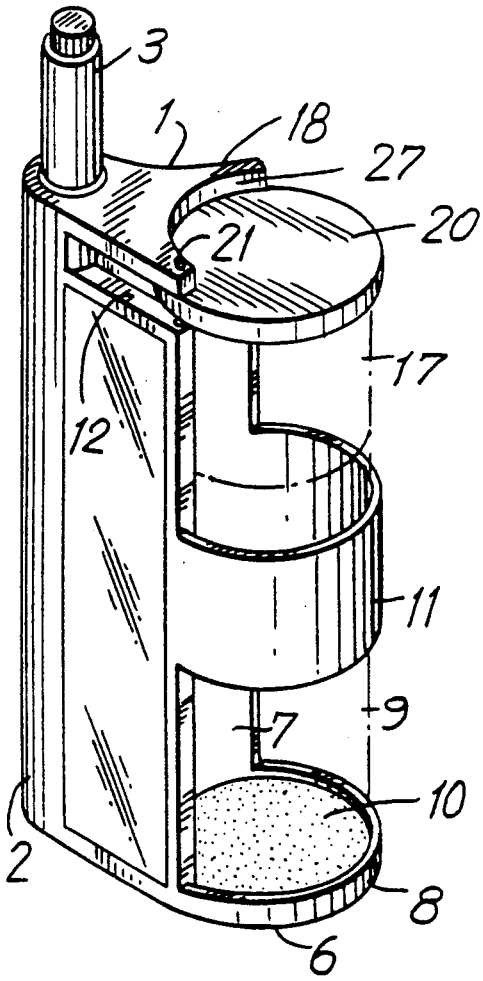
FIG. 1
FIG. 2
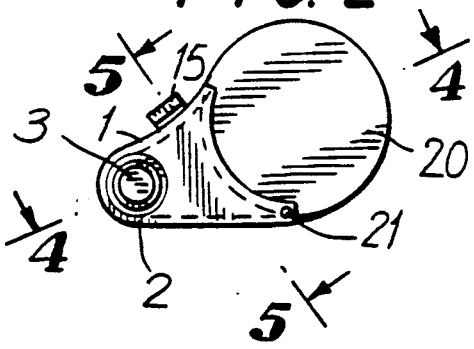
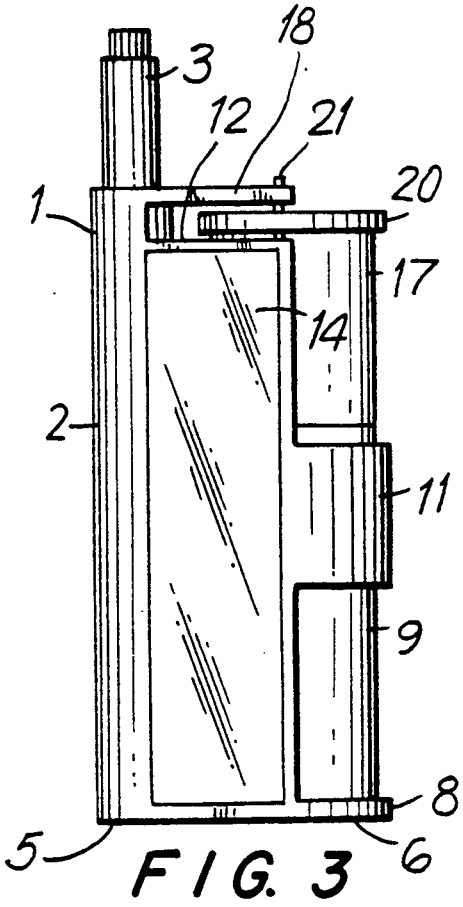
FIG. 3

FIG. 4
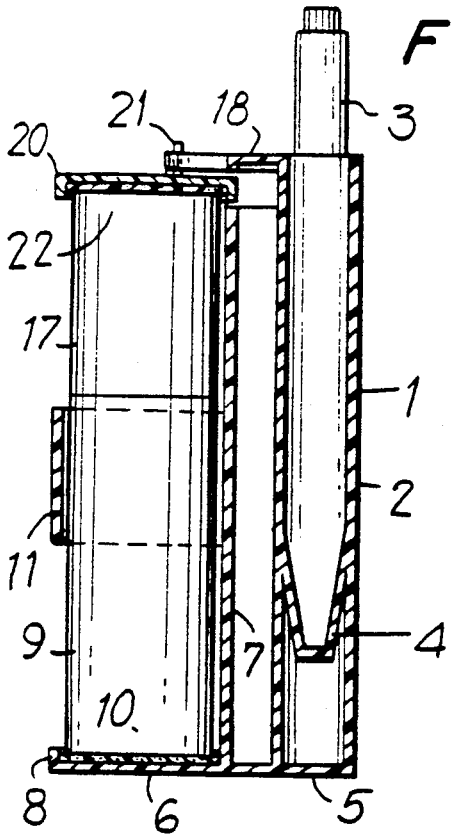
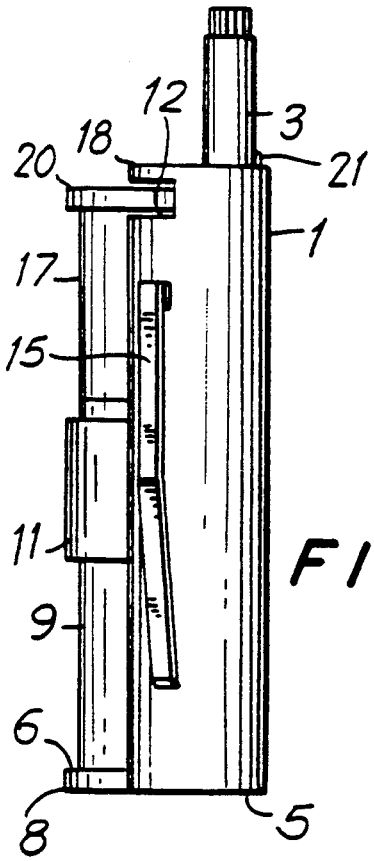
FIG. 6
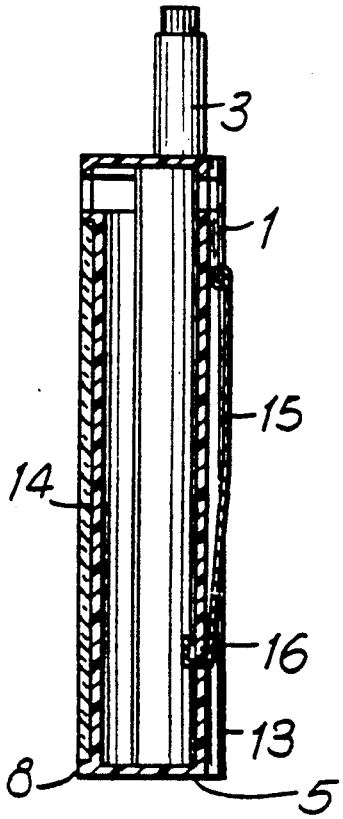
FIG. 5

COMBINED LIPSTICK HOLDER AND LIP BRUSH CASE WITH MIRROR AND CLIP

FIELD OF THE INVENTION

The present invention relates to a combined lipstick holder and lip brush case which facilitates easy application of the lipstick using a lip brush.

DESCRIPTION OF THE PRIOR ART

While lipstick can be directly applied to the mouth, the best method of application of lipstick is through a lip brush. Conventionally, lipstick is held in a holder which consists of a metal or plastic tube which has a mechanism to raise or lower the lipstick out of one end of the tube, usually for direct application. If one wishes to use a lip brush to apply the lipstick, one must locate the lipstick holder, lip brush and a mirror in the user's purse. Then one must remove and store the cap of the lipstick holder and if the lip brush has a cap, remove its cap and store it. If one is using a hand held mirror to apply the lipstick, one must continuously shift one hand between the mirror and the lipstick holder in applying the lipstick. After application, the caps are relocated, reattached and the three separate items replaced loose in the purse.

While there are a number of cases for holding lipstick alone or with other cosmetics, none have been designed to hold a conventional lipstick holder, a lip brush, a mirror and a means to hold the cap of the lipstick holder when the lipstick and the lip brush are being used in combination in such a manner as to facilitate the use of the lipstick, lip brush and mirror.

For example, design patent No. 306,220 to Wang, issued on Feb. 20, 1990, discloses a multi lipstick container with a mirror along one surface. Design patent No. 276,471 to Lo, issued on Nov. 20, 1984, discloses a mirror which clips around a conventional lipstick holder. Des. No. 82,293 to Weidner, issued on Oct. 14, 1930, discloses a combination powder compact, lipstick and atomizer. U.S. Pat. No. 4,562,923 to Katada et al., issued on Jan. 7, 1986, U.S. Pat. No. 2,678,995 to Miller, issued May 18, 1954 and U.S. Pat. No. 1,626,311 to Tipton, issued on Apr. 26, 1927, all disclose compacts having one or more tubes which can hold lipsticks, all in combination with mirrors.

None disclose an easy and convenient case for bundling together all necessary apparatus for applying lipstick by a brush, such that the case can be easily kept in a purse or the like as a unit. None disclose a case adopted to hold a conventional lipstick holder in combination with a lip brush, which allows easy and convenient access of the brush to the lipstick while simultaneously using a hand held mirror. None disclose the use of means to hold the cap of a conventional lipstick holder on the case while lipstick is being applied by means of a brush.

SUMMARY OF THE INVENTION

The object of the present invention is to provide an improved case for holding a lipstick in a conventional lipstick holder in combination with a lip brush to eliminate the above mentioned disadvantages. The case of the present invention consists of cylinder in which the lip brush is held in place by frictional engagement with the interior of the cylinder. Attached to said cylinder and extending from the bottom of said cylinder is an elongated platform having a circular portion on which a conventional lipstick holder can rest. Extending from a section of the circular portion of the platform closest to said cylinder is a concave wall. Extending around the remainder of said circular portion is a lip to aid holding a lipstick holder in place. A circular band extends from one side of the concave wall to the other and in holding the conventional lipstick holder in place. A rotatable cap is pivotal mounted on the top of said concave wall to further hold the lipstick holder. The concave wall is connected to the cylinder which holds the brush by side walls. A mirror can be mounted on one of the said side walls. On the other side wall a clip is mounted for holding the top of a lipstick holder when the lipstick is open. The above apparatus allows application of lipstick by a lip brush with all necessary elements mounted on a single apparatus eliminating the need to alternately shift hands between the lipstick and a mirror.

BRIEF DESCRIPTION OF THE DRAWINGS

Other objects and features of the present invention will be apparent from the following detailed description of the preferred embodiments, by way of example in the accompanying drawings in which:

FIG. 1 is a perspective view of a lipstick and lip brush case in accordance with the present invention having a conventional lipstick holder shown mounted in the case in broken lines;

FIG. 2 is a top elevational view of the case of FIG. 1;

FIG. 3 is a front elevational view of the case of FIG. 1;

FIG. 4 is a partial cross sectional view of the lipstick holder of FIG. 2 taken along plane 4;

FIG. 5 is a partial cross sectional view of a lipstick holder of FIG. 2 taken along plane 5—5; and FIG. 6 is a back elevational view of the case of FIG. 1.

DETAILED DESCRIPTION OF PREFERRED EMBODIMENT

Referring to FIGS. 1-6, a case 1 for a lipstick holder and lip brush in accordance with the present invention is drawn. The case 1 is formed from a hollow cylinder in which a lip brush 3 may be positioned. The opening in hollow cylinder 2 is of a size such that the lip brush 3 is held in position by frictional engagement with the inner surface of cylinder 2. The lip brush 3 may be of any conventional design where the bristles can be withdrawn into the body of the brush when the brush is not in use. The bristles are thus protected when the brush 3 is positioned in hollow cylinder 2.

Internal of hollow cylinder 2 is a stop 4 configured to mate with one end of the lip brush 3 thereby acting to help hold lip brush 3 in proper position relative to case 1. The cylinder 2 is mounted on and integral with a bottom platform 5 which acts to close the bottom of cylinder 2. Bottom platform 5 extends beyond cylinder 2 and at the end farthest from cylinder 2 has a circular portion 6 corresponding in size to the bottom of a conventional lipstick holder 9 (shown in broken lines in FIG. 1). A circular concave wall 7 extends part way around circular portion 6 of bottom platform 5. If the concave wall 7 were extended to completely surround circular portion it would form a cylinder slightly larger in diameter than conventional lipstick holder 9 which would be parallel to cylinder 2. Lip 8 extends from the sides of concave wall 7 around circular portion 6 of bottom platform 5. Lip 8 aids in holding the lipstick in place. Circular band 11 extends from the sides of concave wall 7 to act as a restraint holding conventional lipstick holder 9 in place. Fixedly mounted on circular portion 6 of platform 5 is a foam pad 10 on which the lipstick 9 holder rests.

Cylinder 2 and concave wall 7 are connected by side walls 12 and 13. Side wall 12 is flat and has mirror 14 mounted on it and side wall 13 has clip 15 mounted on it. Clip 15 is anchored to side wall 13 at 16 by any conventional means. Clip 15 is made from metal or plastic and faces upward to receive the top 17 (shown in broken lines in FIG. 1) of lipstick holder 9. Side wall 13 may be curved to better receive and hold lipstick holder top 17 in place.

Top platform 18 is attached to the top portion of cylinder 2. Cap 20 is positioned between top platform 18 and side walls 12 and 13. Cap 20 is circular and slightly larger than the cross section of a conventional lipstick holder 9. It is pivotally attached to top platform 18 and side wall 12 by pivot 21, and thus can rotate to an open or the closed position shown in FIG. 1. In the closed position cap 20 holds the lipstick holder 9 in position. In the open position, cap 20 allows removal of the top 17 of conventional lipstick holder 9 to allow the brush 3 access to the lipstick or to allow replacement of the lipstick holder with another containing a different lipstick. To facilitate removal of the cap 17 or the entire lipstick 9, top platform 18 has a concave cut away positioned at its outer edge 27. Cap 20 has a soft insert 22 such as foam rubber positioned along its bottom surface to cushion the lipstick holder 9.

In use, a conventional lipstick 9 is positioned on bottom platforms 5 at circular portion 6 and is held in place by lip 8, band 11 and cap 20. It is cushioned against injury by cushions 10 and 22. When not in use, the case 1 with lipstick 9, lip brush 3 and mirror 14 holds all the necessary elements to allow application of lipstick by a lipbrush in one convenient unitary package. When it is desired to apply the lipstick, cap 20 is moved from the closed position atop the lipstick, to its open position. The lipstick holder top 17 is positioned on clip 15. The lipstick brush 3 is then removed from the cylinder 2 and the bristles extended from the brush in a conventional manner. The lip brush 3 is then used to apply lipstick in the normal manner while using the mirror 14. The lipstick holder 9 is held in place in the case 1 during the use of the brush to acquire lipstick.

The lipstick holder cap 17 is positioned between clip 15 and wall 13 and thus held in place during the entire application process, without hindering the application or requiring a search for the lipstick holder cap 17 after lipstick has been applied, When application is finished, the cap 17 is removed from clip 15 and positioned on the use end of lipstick holder 9. Cap 20 is moved to the closed position and the brush 3 reinserted into cylinder 2.

While the apparatus has been shown with a conventional lipstick holder, the apparatus may be adapted to use an integral lipstick holder formed in the body of the case 1.

Although the preferred embodiment of the devices described, it will be understood that within the purview of the invention various changes may be made in form, details, proportions and arrangements of the parts, the combination thereof, and the mode of operation which generally stated consists of a device capable of carrying out the objects set forth as disclosed and defined in the appended claims.

Having thus described my invention, I claim:

1. A lipstick and lip brush case comprising:

(a) an elongated hollow member having one open end and an opposite closed end;

(b) a lipstick brush in said hollow member;

(c) a first platform extending from the closed end of said member opposite said open end and having an enlarged circular portion spaced from said member;

(d) a concave wall surrounding part of said circular portion of said first platform and attached to said hollow member by two side walls;

(e) a lipstick holder for containing a lipstick therein, said holder having a use end and an opposite end, said holder extending along said concave wall with said opposite end of said holder supported on said circular portion of said first platform;

(f) a second platform extending from the open end of said member adjacent said use end of said holder;

(g) a movable cover connected to said second platform which, in a first position covers the use end and holds the lipstick holder in place on said first platform and in a second position, allows access to said lipstick holder use end, while said lipstick holder is positioned on said first platform; and (h) a band attached to said concave wall and extending around said lipstick holder, said band being spaced from said enlarged portion of said first platform and from said cover to expose upper and lower portions of the holder.

2. A lipstick and lip brush case according to claim 1, wherein the elongated hollow member has an axis, said cover being pivotally mounted to said second platform by a pivot extending parallel to the axis so that said cover is movable sideways away from the use end of said lipstick holder for access to said lipstick holder use end.

3. A lipstick and lip brush case according to claim 2, including a cap removably engaged over the use end of said lipstick holder and adjacent the second platform and movable cover.

4. A lipstick and lip brush case according to claim 3, including clip means connected to one of said side walls for holding the cap when the cap is removed from the lipstick holder.

5. A lipstick and lip brush case according to claim 4, including a mirror connected to the other of said side walls opposite from said clip means, the other of said side walls being substantially flat.

6. A lipstick and lip brush case according to claim 5, including cushion means on said circular portion of said first platform to protect said lipstick holder.

7. A lipstick and lip brush case according to claim 6 including a lip extending upwardly of and around the circular portion of the first platform, said lip being spaced away from said band.

* * * * *